United States Patent [19]

Hampton et al.

[11] 4,447,203

[45] May 8, 1984

[54] FLAME COMBUSTION OF CARBONACEOUS FUELS

[76] Inventors: William J. Hampton; Glenn R. James, both of 101 Adkisson Way; Raymond L. Hatch, 209 E. Warren St., all of Taft, Calif. 93268

[21] Appl. No.: 525,421

[22] Filed: Aug. 22, 1983

Related U.S. Application Data

[63] Continuation of Ser. No. 211,347, Nov. 28, 1980, abandoned, which is a continuation-in-part of Ser. No. 956,434, Oct. 31, 1978.

[51] Int. Cl.[3] ..... F23J 7/00

[52] U.S. Cl. ..... 431/3; 431/4

[58] Field of Search ..... 431/3, 4; 134/27, 28; 423/210, 240–244

[56] References Cited

U.S. PATENT DOCUMENTS

| | | | |
|---|---|---|---|
| 2,800,172 | 7/1957 | Romer et al. | 431/3 |
| 3,746,498 | 7/1973 | Stengel | 431/4 |
| 3,925,001 | 12/1975 | Salooja | 431/4 |
| 4,129,409 | 12/1978 | Young | 431/3 |
| 4,235,585 | 11/1980 | Anderson | 431/3 |
| 4,331,638 | 5/1982 | Michelfelder | 431/4 X |

FOREIGN PATENT DOCUMENTS

| | | | |
|---|---|---|---|
| 2500683 | 7/1976 | Fed. Rep. of Germany | 431/3 |

*Primary Examiner*—Samuel Scott
*Assistant Examiner*—Margaret A. Focarino
*Attorney, Agent, or Firm*—Donald D. Mon

[57] ABSTRACT

A method for improving the flame combustion of carbonaceous fuels. The method enables the reduction of oxides of nitrogen generated by the flame combustion, and enables an improvement in boiler efficiency. An ionic sodium or potassium compound, or a combination of them, is supplied with the combustible mixture of fuel and air so as intimately and uniformly to be present where and when the flame exists. Preferably the compound is supplied in an aqueous solution, and can be intimately mixed with the fuel, or with the atomizing air or steam, or with the combustion air. The process is useful with both single-stage and staged (multiple-staged) combustion systems.

25 Claims, 1 Drawing Figure

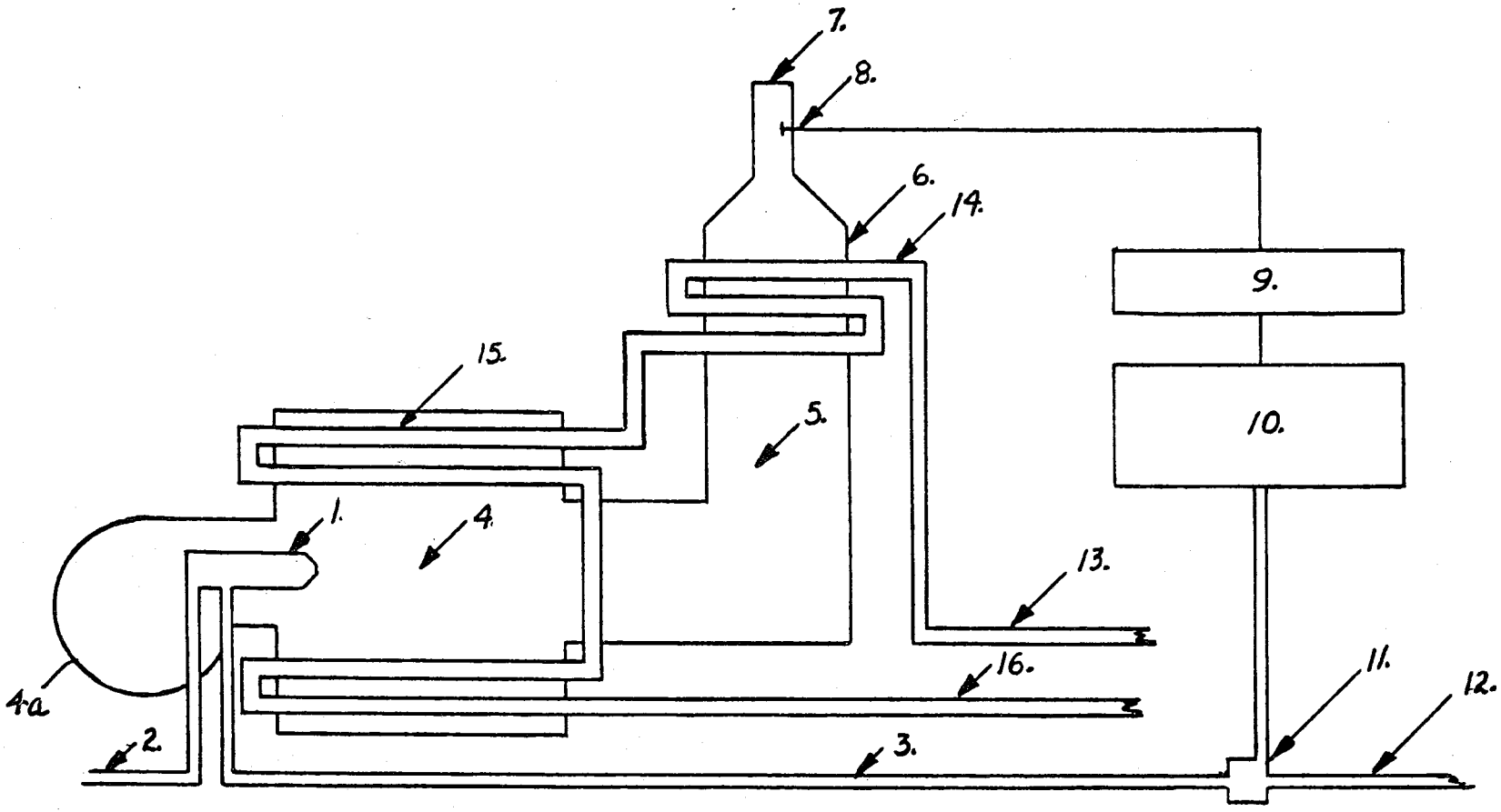
7.
8.
6.
14.
9.
10.
13.
5.
15.
4.
1.
4a
2
3.
16.
11.
12.

FLAME COMBUSTION OF CARBONACEOUS FUELS

CROSS-REFERENCE TO OTHER PATENT APPLICATION

This is a continuation of applicant's co-pending patent application, Ser. No. 211,347, filed Nov. 28, 1980, entitled "Improvements in Flame Combustion of Carbonaceous Fuels", now abandoned which in turn is a continuation-in-part of applicant's co-pending patent application, Ser. No. 956,434, filed Oct. 31, 1978, entitled "Combustion Pollution Neutralizer", which is hereby incorporated herein by reference, in its entirety, as though fully set forth herein.

FIELD OF THE INVENTION

This invention relates to the reduction of oxides of nitrogen which tend to be generated during the flame-type combustion of carbonaceous fuels, and to improve the boiler efficiency. The term "carbonaceous fuels" includes liquid petroleum fuels, gaseous petroleum fuels such as LPG and LNG, coal, coal slurries, and derivatives of these, for example, coke. The principal ones of these fuels are the fossil fuels.

BACKGROUND OF THE INVENTION

Steam generated in fossil fuel-fueled boilers is widely used in industry, especially in electrical power generation, and in oil fields to generate steam where secondary and tertiary recovery of oil is conducted. These are high-temperature boilers with substantial capacities, usually using liquid fuel oil or natural gas, and the quantity of pollutants produced by them is considerable. Oxides of nitrogen, which are generated primarily in the combustion flame, are of particular concern. In fact, the matter is so serious that if the pollution rate is not reduced, further increases in production of heavy oil, which is dependent on heat are threatened, because to generate so much additional heat with existing combustion processes threatens to increase the total atmospheric pollution to unacceptable levels.

It is an object of this invention to provide a simple method for reducing the level of oxides of nitrogen which are generated in the flame combustion of carbonaceous fuels.

It is another object of the invention to improve the efficiency of a boiler by enabling its burner to operate with close-to-stoichiometric mixtures, thereby enabling the effluent gases to remain longer in the heat exchanger as a consequence of the reduced flow of gas per unit of fuel that is burned.

DISCUSSION OF THE PRIOR ART

In Stengel U.S. Pat. No. 3,746,498, the reduction of nitrogen oxides in a flange combustion process if discussed. In this process, various formates and oxalates (including sodium formate and sodium oxalate) are injected into the first stage of a two stage ("staged") combustion process. This first stage is fuel-rich, and its effluent gases are subsequently reacted with air in a secondary combustion stage, primarily to reduce carbon monoxide. Stengel neither shows nor suggests what his fuel is to be-whether gaseous or liquid, nor the condition in which his additive compound is injected, i.e., whether as a powder, a solution, or a suspension. Stengel teaches the injection of only oxylates and formates into a fuel rich flame for $NO_x$ reduction.

BRIEF DESCRIPTION OF THE INVENTION

This invention is carried out in a burner system fueled with carbonaceous fuel. The system may be either single stage or "staged", i.e. multiple staged. In a single stage system, all of the combustion air is added in the initial combustion of the fuel. In a staged system, the first stage is run rich, and then additional air is added to complete the combustion. In both systems, the fuel is injected through a fuel nozzle into a combustion chamber where it is mixed with combustion air to form the flame and generate heat. When the fuel is a liquid, it is customary to atomize the fuel with either compressed air or steam to be mixed with the fuel at the fuel nozzle or to use well known mechanical atomizers. When the fuel is gaseous, then atomizing air or steam is not needed. Powders or slurries are customarily blown in. In every case, the combustion air is provided, usually under pressure to a region into which the atomized fuel is sprayed (or into which a gaseous or solid fuel is discharged under pressure). Observation of the combustion chamber discloses a plume-like flame downstream from the fuel nozzle. In a staged system, secondary air is introduced to the combustion chamber downstream of the primary combustion air entry point.

According to a feature of this invention, an ionic compound of sodium or of potassium, or a mixture of two or more of them, is caused to be present when and where combustion is initiated. It can, for this purpose, be added to the combustion air, or to the atomizing air or stream, or to the fuel. It is thereby intimately and uniformly mixed with the combustion air or with the fuel, or with both, and this mixing has been accomplished prior to the flame combustion process itself so it is intimately and uniformly present at the combustion situs.

The invention will be fully understood from the following detailed description and the accompanying drawings, in which:

BRIEF DESCRIPTION OF THE DRAWINGS

The single FIGURE schematically shows a boiler utilizing the invention.

DETAILED DESCRIPTION OF THE INVENTION

A fuel nozzle 1 receives atomizing medium such as compressed air or steam from conduit 2, and liquid fuel from a fuel supply conduit 3. The fuel is atomized, i.e., divided into very small droplets, and is ejected from the nozzle as a stream, under pressure, into the radiant section of a fire box. Combustion air (atmospheric) is supplied by a schematically-shown blower *4a*, in a stream flowing past the nozzle in such a way that the air and fuel are turbulently mixed. When ignited, a plume-like flame (not shown) extends downstream (to the right in the FIGURE) from the nozzle. The rates of supply of combustion air, fuel, and atomizing medium are, of course, adjustable. This is a completely conventional single stage liquid-burning system.

If staged combustion were used, less atmospheric air would be provided by blower *4a*, and a second source (not shown) of combustion air would be injected into the radiant section downstream of the primary combustion air entry point. If gaseous fuel is used, an appropriate nozzle 1 would be provided, and atomizing medium would not be used.

Some heat which is generated by the flame process is recovered from the radiant section by heat exchanger 15. Additional heat is recovered downstream.

Immediately after the combustion phase, a vapor phase occurs in radiant section 4 and also in transition section 5. Additional heat removal occurs in convection section 6. Conduits 13 and 16 provide for boiler tube feed and steam removal. Gases exhaust to atmosphere through stack 7.

While the benefits of this invention can be obtained over a wide range of additive concentrations, it may be desirable, especially for minimizing particulates in the stack gases and to optimize the contents of the exhaust gases, having several variables in mind, to be able to adjust the rate of supply of additive on a running basis as a function of some parameter of the stack gas. $NO_x$ concentration could be one such parameter. Should such an arrangement be desired, then for this purpose, a sensor 8 responsive to the parameter (perhaps $NO_x$ concentration) will be exposed to the stack gas. It will generate a signal effective on control 9 which will determine the rate of supply of additive.

Preferably, the additive will be supplied as an aqueous solution. In such case, it will be supplied from a source by a variable rate pump (together schematically shown by block 10), the pumping rate being controlled by control 9.

The additive solution is intimately mixed by mixer 11 with fuel from a fuel conduit 12 (from a fuel supply).

The rate of flow of fuel is controlled by pumps and valves (not shown) which are completely conventional. The fuel stream with the additive mixed in it, flows through conduit 3 to the burner. The mixer will assure the additive is uniformly mixed in the fuel stream.

Should gaseous fuel be used instead of liquid, gas would be supplied from line 12, and the mixer would include means, to finely divide and uniformly mix the additive in the fuel stream. The same would be true of dry powdered fuels. Slurries would be handled like liquid fuels.

The most convenient means for supplying additive is by solution or suspension. However, its addition by way of a suitably finely divided powder is also effective but more troublesome. When solutions or suspensions are used, adjustment of additive supply rates is as simple as speeding up or slowing down a pump. Instead of aqueous solution, alcohol solutions or oil suspensions can be used, depending on the solubility or particle size of the compound used as an additive.

The additive can also be supplied by placing it in the fuel or other stream where it will be entrained as the consequence of abrasion or solution.

If the percentage of additive in the fuel can be expected to remain sensibly constant, the adjustments and controls can be eliminated, and the additive can simply be mixed with the fuel in its storage tank. Of course, adequate agitation may be required to keep it well mixed, especially if an aqueous solution is used in a liquid fuel such as residual fuel oil.

When the additive is injected with the combustion air, or with atomizing air or steam, similar metering, injection and mixing means will be provided. They will, of course, be appropriate to the medium into which the additive is injected.

An investigation has been made of a wide range of substances to determine their effectiveness in reducing $NO_x$ concentrations. In particular, efforts have been made to determine substances and their concentrations which would result not only in reduction of $NO_x$ concentrations, but do so without requiring a substantial excess of oxygen in the stack gases. This latter effort is based on the fact that reduction of oxygen in the combustion chamber will tend to reduce the amounts of oxides of nitrogen which can be formed. While there is always ample nitrogen in the stream, the amount of oxygen available to react with the nitrogen will be less at stoichiometric or nearly stoichiometric operation than at very lean operation. It goes without saying that it is no solution to the problem to operate at fuel-rich levels, because of the economic waste, and of the hydrocarbon emissions and smoke produced.

It appears that the ionic compounds of sodium or of potassium, or a mixture of one or more of them provides the advantages of this invention. Investigation has shown that the selection of the anion is unimportant to this function although some may be more compatible with the equipment and more economical than others. Therefore, any ionic compounds of sodium or of potassium, i.e., a compound with sodium or potassium as an ionic cation, is within the meaning of this definition. Water soluble ionic compounds of sodium or potassium constitute a sub-class, desirable because of their ease of use. Examples are the citrates, oxalates, formates, hydroxides, carbonates, and bicarbonates.

Best of all are sodium hydroxide, potassium hydroxide, or mixtures thereof. These are reasonably priced, their handling is well understood, and they are readily obtainable. In the quantities used, the hydroxides do not produce offensive quantities of particulates. This is true of other compositions, also, but most of them do not offer all of the other advantages of the hydroxides. Still another advantage is that the hydroxides does not produce downstream products which might damage conventional boiler equipment.

For example, although sulphates will function well to reduce oxides of nitrogen, the resulting sulphur emission is undesirable. Also nitrogen-containing anions, while their contribution to $NO_x$ is relatively small, still do contribute to it. Chlorides may involve problems of corrosion by the stack gases. Also, it is generally preferred not to use organic anions because of their tendency to produce reducing agents. Therefore, while these compounds all will function, and are included in the functional group, in general they will be avoided because of their disadvantages, and the preferred group excludes them.

If the additive is to be provided as a solid, it should be of sub-micron particle size to provide for suitable dispersion. In fact, if the additive is added to the combustion air, or to gaseous fuels, it may be best practice to provide it as such a particle, because an aerosol dispension of an aqueous solution might not, after evaporation, provide a suitably small particle. Of course, mixing an aqueous solution into a liquid fuel does not involve such problems. Still, the intimate mixing techniques can involve the use of liquid mixtures, solutions, dispersions, suspensions, gas-aerosol and gas-cloud dispersions, and abraded or dissolved substances in one or all of the streams.

The amount of additive to be provided per unit of fuel in a particular installation and for a given fuel can be determined by brief and simple experimentation. Within a very broad range, the additive does not interfere with the combustion. The problem is not to put in the maximum, but instead to use a minimum, because the additive will be emitted from the system as a particulate, or part of a particulate. Therefore, with fuel oil, for example, the weight percentage of additive on a dry basis, while a higher value can be used, will not usually exceed 5%. The lowest useful value appears to be about 0.001%, and the preferred range is between about 0.05% and 1%, regardless of the compound used. However, these values are particularly applicable to the hydroxides, and relate to conventional liquid residual heating oil of the type customarily used for boiler firing. For other fuels, the amounts can quickly be determined by adjusting them, and measuring $NO_x$ and particulate levels.

In particular, test runs on a 25,000,000 BTU per hour boiler system, burning residual heating oil at a rate of 1,400 lbs. per hour, with sodium hydroxide added at the rate of the number of pounds per hour stated below, revealed the following:

| NaOH lbs/hr | $O_2$ % by volume | $NO_x$ in ppm at 3% $O_2$ |
|---|---|---|
| 0 | 2.8 | 322 |
| 15 | 2.8 | 148 |
| 2.8 | 0.3 | 71 |
| 1.2 | 0.6 | 108 |
| 0.7 | 0.9 | 171 |
| 0.7 | 0.2–0.3 | 88 |

The term "$NO_x$" in ppm at 3% $O_2$" means nitrogen oxides in the effluent gas calculated at a standard condition of 3% oxygen in the effluent gas.

In the above example the additive (NaOH) was provided in aqueous solution in a concentration ranging from 50% to 2% by weight. The 2% concentration appears to be about optimum for its mixing properties with the oil in this particular boiler. When proportioning devices are used to proportion the combustion air to the fuel, adjustment will, of course, be made to account for the percentage of liquid flowing through the nozzle which is water, and not combustible fuel.

The effects of providing the additive to the combustion in the manners described are quite dramatic to observe. It is useful to monitor the system for $NO_x$ and $O_2$, and to observe for dense smoke. A system properly adjusted for use of the additive will, if the additive is cut off, quickly start to produce dense black smoke. When additive is again added, the smoke ceases. This is at a condition rather closely approaching stoichiometric. Of course, smoke can be avoided by running with higher oxygen levels by adding air, but observation of the monitoring instruments then shows a rapid rise in oxygen levels, and an accompanying increase in $NO_x$. Then, adding the additive, a decrease in $NO_x$ will be observed, but even better, the mixture can be trimmed toward stoichiometric, reducing the oxygen level, and the $NO_x$ concentration decreases dramatically. The combustion efficiency is correspondingly increased. This is because less gas must flow through the heat exchange section per unit of fuel burned. As a consequence, the velocity is reduced and the residence time is increased, which markedly increase the efficiency of the boilers. This feature will often be found to be desirable whether $NO_x$ is to be reduced or not. This system readily reduces $NO_x$ to within the 100 ppm corrected to 3% $O_2$ level, with oxygen levels well under 1% by volume.

By using a basic additive, such as hydroxides, sulfuric acid formed from some fuels will be neutralized. Also, by using less combustion air, less acid will be formed. For both reasons, stack gases can be cooled because it is unnecessary to protect the boiler from corrosion by the acid, which is usually done by discharging hot gases. Enabling the use of cooler boiler feed water can save on the order of 5% of the total output, and efficiency is further improved.

This invention provides a simple technique, readily adaptable to standard burner systems, for both "regular" (single stage) and "multiple" ("staged") combustion. In staged combustion, the only difference is that less than the stoichiometric amount of air is introduced into the first stage, and secondary air to complete the combustion is introduced in the second stage. This invention can, by reducing the output of $NO_x$ per unit of fuel burned, increase the permissible amount of fuel to be burned in a region where the total $NO_x$ output is a limitation, and enable a boiler to be operated with greater efficiency.

What is meant by the terminology of supplying the additive at the situs of combustion is that the additive is present where the combustion of the fuel is initiated, i.e., precisely where the fuel and air begin to react with one another, and not merely sprayed or injected in someplace else in the reaction chamber. For this purpose, mixing of the additive into combustion air atomizing medium, or even better into the fuel itself is preferred practice, because this provides for the uniform and intimate presence of additive whenever and wherever the combustion occurs. This also aids in avoiding variations should the flame's orientation in the chamber vary, perhaps by partial plugging of a fuel injector passage. An additive merely injected into the chamber might well miss part of the flame and be ineffective to some degree.

The additive need not be added in pure form. It may be that other substances might improve other functions of the combustion system. If so, they could be added to the additive solution.

This invention is not to be limited by the embodiments shown and described herein, which are given by way of example and not of limitation, but only in accordance with the scope of the appended claims.

We claim:

1. The method of reducing the production of nitrogen oxides in a flame combustion process utilizing carbonaceous fuel and combustion air, comprising: bringing said fuel and air together in a combustible ratio, and maintaining a flame for combustion of said fuel, and supplying an additive so that said additive is uniformly present at the situs of said combustion, said additive comprising one or more ionic compounds of sodium or one or more ionic compounds of potassium, or mixtures thereof, in amounts which reduce the $NO_x$ generated in said combustion below the amount produced without said additive being present, said additive being uniformly and intimately pre-mixed, prior to introduction into the region where combustion occurs, throughout all of the fuel, or throughout all of such of said air as is provided to the fuel where combustion begins, or throughout both.

2. The method according to claim 1 in which the additive is premixed with the fuel.

3. The method according to claim 1 in which the additive is premixed with steam or air used to atomize the fuel.

4. The method according to claim 1 in which the additive is premixed with the combustion air.

5. The method according to claim 1 in which the additive is supplied as an aqueous solution.

6. The method according to claim 1 in which said compounds have inorganic anions.

7. The method according to claim 1 in which said compounds are sodium hydroxide and potassium hydroxide.

8. The method according to claim 1 in which the combustion is conducted in a single stage, all necessary combustion air being initially pre-mixed into said fuel.

9. The method according to claim 1 in which the combustion is conducted in a plurality of stages, said additive being pre-mixed in the air added to the first of said stages, and in which supplementary air is added in a subsequent stage which does not necessarily contain said additive.

10. The method according to claim 8 in which liquid fuel is used, and in which the compounds are sodium hydroxide and potassium hydroxide.

11. The method according to claim 10 in which the additive is premixed into said fuel, as an aqueous solution, prior to combustion.

12. The method according to claim 9 in which liquid fuel is used, and in which the compounds are sodium hydroxide and potassium hydroxide.

13. The method according to claim 12 in which the additive is premixed into said fuel, as an aqueous solution, prior to combustion.

14. The method according to claim 8 in which liquid fuel is used, and in which the weight percentage of additive on a dry basis is between about 0.001% and 10% of the fuel.

15. The method according to claim 9 in which liquid fuel is used, and in which the weight percentage of additive on a dry basis is between about 0.001% and 10% of the fuel.

16. The method according to claim 1 in which a gaseous fuel is used.

17. The method according to claim 16 in which the compounds are sodium hydroxide and potassium hydroxide.

18. The method according to claim 16 in which the compound is supplied in dry form as a sub-micron sized particle.

19. The method of improving the efficiency of a boiler fired by the flame combustion of a carbonaceous fuel with atmospheric air, comprising: bringing said fuel and air together in a combustible ratio, and maintaining a flame for combustion of said fuel, and supplying an additive so that said additive is uniformly present at the situs of said combustion, said additive comprising one or more ionic compounds of sodium, or one or more ionic compounds of potassium, or mixtures thereof, in amounts which enable the combustion to occur at near-to-stoichiometric, but still lean mixture ratios without the generation of smoke, said additive being uniformly and intimately pre-mixed, prior to introduction into the region where combustion occurs, throughout all of the fuel, or throughout all of such of said air as is provided to the fuel where combustion begins, or throughout both.

20. The method according to claim 19 in which the additive is premixed with the fuel.

21. The method according to claim 19 in which the additive is premixed with steam or air used to atomize the fuel.

22. The method according to claim 19 in which the additive is premixed with the combustion air.

23. The method according to claim 19 in which the additive is supplied as a aqueous solution.

24. The method according to claim 19 in which said compounds have inorganic anions.

25. The method according to claim 19 in which said compounds are sodium hydroxide and potassium hydroxide.

* * * * *